United States Patent [19]

Demuth et al.

[11] Patent Number: 4,460,021

[45] Date of Patent: Jul. 17, 1984

[54] CATCHER AND A METHOD OF OPERATING A GRIPPER PROJECTILE CATCHER

[75] Inventors: Hans Demuth, Winterthur, Switzerland; Walter Gruber, Constance, Fed. Rep. of Germany

[73] Assignee: Sulzer Brothers, Limited, Winterthur, Switzerland

[21] Appl. No.: 482,244

[22] Filed: Apr. 5, 1983

[30] Foreign Application Priority Data

May 7, 1982 [CH] Switzerland ..... 2839/82

[51] Int. Cl.[3] ..... D03D 49/56

[52] U.S. Cl. ..... 139/185; 139/439

[58] Field of Search ..... 139/185, 186, 187, 429, 139/439

[56] References Cited

U.S. PATENT DOCUMENTS

| | | | |
|---|---|---|---|
| 3,865,150 | 2/1975 | Demuth | 139/185 |
| 4,169,492 | 10/1979 | Grady | 139/185 |
| 4,192,354 | 3/1980 | Pfarrwaller | 139/439 |

*Primary Examiner*—Henry Jaudon

*Attorney, Agent, or Firm*—Kenyon & Kenyon

[57] ABSTRACT

The catcher is operated so that prior to moving the projectile back into the ejection position, the brake block of the second braking station is disengaged while the first brake block remains in a braking position. Friction on the projectile and brake linings of the second braking station is reduced with a corresponding reduction in wear.

In one embodiment, the braking stations are constructed with independent brake blocks. In a second embodiment, a common brake block may straddle the two braking stations.

6 Claims, 2 Drawing Figures

CATCHER AND A METHOD OF OPERATING A GRIPPER PROJECTILE CATCHER

Figure 1:
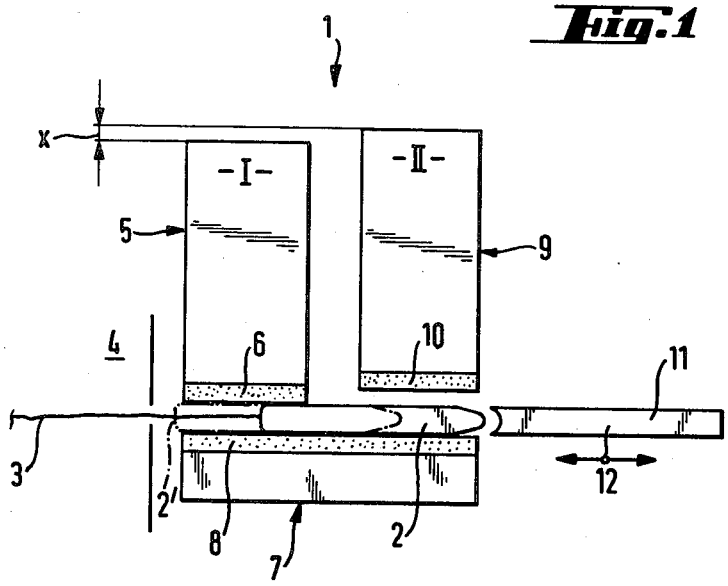

This invention relates to a catcher and to a method of operating a gripper projectile catcher for a weaving machine.

As is known, various types of catchers or the like mechanisms have been used in gripper projectile type weaving machines to brake and position a gripper projectile. In some cases, the catchers have been constructed with two braking sections or stations and a following projectile ejector. In operation, after a projectile has been braked to a stop, the ejector has been actuated in order to push back the projectile into an ejection position. After being positioned in the ejection position, a yarn clamp within the projectile can be opened and the projectile thereafter transferred to a return mechanism for returning the projectile to a picking side of the weaving machine.

Generally, the distance over which the projectile is pushed back by an ejector, i.e. the ejection distance, is about fifty millimeters. Further, the projectile is usually subjected to a very high rearward acceleration by the ejector. Accordingly, in order to prevent the projectile from moving out of the catcher, an event which would lead to severe damage of the weaving machine, the catcher remains closed during the ejection movement. However, this increases the energy consumption of the ejector while also increasing the wear on the catcher and projectile as a result of the substantial friction which is created. In addition, an intense heating which occurs also contributes to the wear of the components.

Accordingly, it is an object of the invention to provide a method of operating a catcher of a weaving machine with reduced wear on the catcher and projectile.

It is another object of the invention to provide a catcher of relatively simple construction which can operate under reduced wear.

Briefly, the invention provides a method of operating a gripper projectile catcher of a weaving machine which comprises the steps of braking a projectile travelling in a picking direction under a braking force in at least two sequentially disposed braking stations to a stop of thereafter reducing the braking force in the last of the braking stations while retaining the braking force in the first of the braking stations, and of then moving the stopped projectile in a reverse direction to an ejection position.

The invention also provides a catcher which is constructed with a pair of sequentially disposed braking stations, an ejector for moving a stopped projectile to the ejection position and means for reducing the braking force in a last one of the braking stations prior to movement of the stopped projectile to the ejection position.

In one embodiment, the braking stations are constructed in substantially identical manner with a reciprocally mounted brake block. In this embodiment, a suitable means such as a cam can be used to raise the brake block of the last braking station away from the stopped projectile in order to remove the braking force from the projectile in this station.

In another embodiment, use is made of a single brake block for two braking stations. In this case, the brake block is pivotally mounted at one end and is connected to a lever at the opposite end. This lever is positioned within the second braking station so that upon actuation of the lever, the brake block can be raised away from the stopped projectile.

Figure 2:
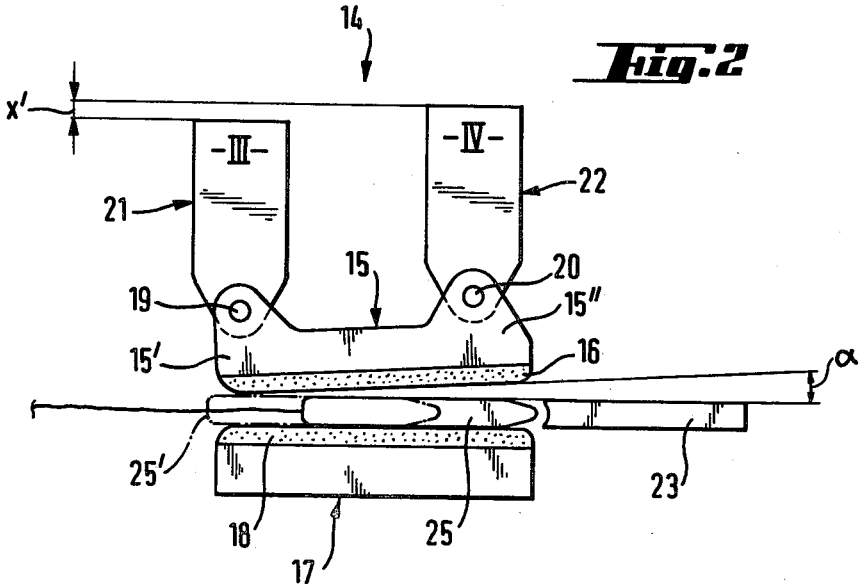

These and other objects and advantages of the invention will become more apparent from the following detailed description taken in conjunction with the accompanying drawings wherein:

FIG. 1 illustrates a front view of a catcher which is operated in accordance with the invention; and FIG. 2 illustrates a front view of a modified catcher constructed in accordance with the invention.

Referring to FIG. 1, the catcher 1 is disposed on a catching side of a weaving machine (not shown) and is adapted to brake a gripper projectile 2 which has pulled a weft yarn 3 through a shed 4 to a complete stop or standstill.

The catcher has a pair of braking stations I, II, which are sequentially disposed relative to the picking direction of the projectile 2. The first braking station I includes a brake block 5 having a brake lining 6 and a stationary brake cradle or support 7 having a brake lining 8. In like manner, the last braking station II includes a brake block 9 having a brake lining 10 opposite the brake cradle 7. Each brake block 5, 9 is reciprocally mounted for movement in a vertical plane, as viewed, relative to the brake support 7 at the cadence of the weaving machine. For example, a means in the form of a cam (not shown) which is driven off a main shaft of the machine is used to reciprocate the brake blocks 5, 9.

As shown, the catcher 1 also has an ejector 11 which is reciprocally mounted for movement in the direction indicated by the arrow 12 at the cadence of the machine by a suitable ejector mechanism (not shown). This ejector 11 serves to move a stopped projectile 2 in a reverse direction from the picking direction to an ejection position in known manner.

The catcher is also provided with a means for reducing the braking force on the last braking station II while maintaining the braking force in the first braking station I prior to movement of the stopped projectile to the ejection position via the ejector 11. In this regard, the means for reducing the braking force is constituted by the cam which reciprocates the brake block 9. That is, the cam is constructed so that the brake block 9 can be disengaged or moved by a small amount x away from the projectile 2 in order to remove the braking force.

The operation of the catcher is as follows:

Upon arrival of the projectile 2, the two blocks 5, 9 are actuated by the common cam (not shown) so that both blocks 5, 9 simultaneously brake and stop the projectile 2. The cam then moves the brake block 9 upwardly by the amount x before the ejector 11 is actuated. However, the cam for the initial brake block 5 is such that the brake block 5 remains in the braking position so that the projectile 2 cannot make an uncontrolled movement during the return or ejection movement.

Next, the ejector 11 is actuated to move the projectile 2 to the ejection position.

Since the second brake lock 9 is at least partially off during the return or ejection movement of the projectile 2, the friction which is operative on the projectile 2 and on the linings 10, 8 as well as the energy required for ejection are reduced. Once the projectile 2 has reached the ejection position, the initial brake block 5 is disengaged. Thereafter, the projectile 2 is pushed laterally out of the catcher and conveyed back to the picking station in known manner.

Referring to FIG. 2, the catcher 14 may be constructed with a single brake block 15. As indicated, this brake block 15 has a brake lining 16 which cooperates with an opposed stationary brake support 17 having a brake lining 18. As indicated, the brake block 15 bridges over two braking stations III, IV and is provided with a means for pivoting the block 15 about an axis at one end for movement away from the brake support 17 at the opposite end, i.e. within the braking station IV. In this regard, this means includes a brake lever 21, 33 in each braking station III, IV each of which is pivotally connected to a respective end of the brake block 15 via a pivot pin 19, 20.

As indicated, the initial brake station III is constituted by the brake lever 21 and one part 15' of the brake block 15 and by the brake support 17. The brake station IV is constituted by the brake lever 22 and a portion 15" of the brake block 15 and by the brake support 17.

The brake levers 21, 22 are actuated by a cam, (not shown) and each is reciprocally mounted for movement in a vertical plane, as viewed. In addition, the lever 22 is mounted for movement over a distance x' in order to pivot the brake block 15 about the pivot pin 19.

As shown, the catcher is also provided with an ejector 23 which operates in a manner as described above.

In operation, upon arrival of a projectile 25, the brake levers 21, 22 are actuated equally by the common cam so that the projectile 2 is simultaneously braked and brought to a standstill by the brake block 15 within the braking stations III, IV. The cam for the brake lever 22 is such that the lever 22 is raised by the small amount x' before the projectile 25 is returned to the ejection position 25' by the ejector 23. At this time, the brake lock 15 is pivoted counterclockwise, as viewed, about the pivot pin 19 through a small angle $\alpha$ so that the braking force in the brake station IV is correspondingly reduced or removed. However, the cam for the brake lever 21 is such that the lever 21 remains in position and the braking effect does not change in the braking station III. Thus, the projectile return or rejection movement is fully controlled. Once the projectile 25 has reached the ejection position 25', the brake lever 21 is actuated by the cam so that the brake block 15 is brought into a position parallel to the brake support 17. At this time, the brake block is spaced from the projectile 2 and the projectile 2 can be ejected in known fashion.

The invention thus provides a catcher as well as a method of operating a catcher for a gripper projectile in which wear of the parts of the catcher is reduced. Because of the reduction in wear, and particularly in the friction imposed upon the projectile, the catcher may have a prolonged useful life.

The operation of the catcher is such that a minimum amount of energy is consumed for the return movement of the projectile. Further, since there is no change in the braking effect on the initial braking station, the projectile cannot undergo any uncontrolled movement during the return movement which is likely to damage the weaving machine.

What is claimed is:

1. A method of operating a gripper projectile catcher of a weaving machine comprising the steps of braking a projectile traveling in a picking direction under a braking force in at least two sequentially disposed braking stations to a stop;

reducing the braking force in the last of the braking stations while retaining the braking force in the first of the braking stations; and moving the stopped projectile in a reverse direction to an ejection position.

2. A method as set forth in claim 1 wherein the catcher has a single brake block common to said braking stations and wherein said brake block is pivoted to reduce said braking force in said last braking station.

3. A catcher for a gripper projectile in a weaving machine comprising a pair of sequentially disposed braking stations for imposing braking forces on a projectile traveling in a picking direction to brake the projectile to a stop;

an ejector for moving a stopped projectile in a reverse direction from said picking direction to an ejection position; and means for reducing the braking force in a last one of said braking stations while maintaining the braking force in the first one of said braking stations prior to movement of the stopped projectile to said ejection position.

4. A catcher as set forth in claim 3 wherein said last braking station includes a reciprocally mounted brake block.

5. A catcher as set forth in claim 3 having a single brake block and a stationary brake support defining said stations, and means for pivoting said brake block about an axis at one end for movement of said brake block away from said brake support at an opposite end.

6. A catcher as set forth in claim 5 wherein said means includes a brake lever in said last station connected to said brake block for pivoting of said brake block.

* * * * *